United States Patent [19]

Fairey et al.

[11] 4,084,682

[45] Apr. 18, 1978

[54] INKED RIBBON GUIDE MEMBER WITH TRACKING SURFACES THEREON

[75] Inventors: Brian M. Fairey, Waterloo; Paulus E. Plasschaert, Listowel, both of Canada

[73] Assignee: NCR Canada Ltd. - NCR Canada Ltee, Mississauga, Canada

[21] Appl. No.: 753,045

[22] Filed: Dec. 22, 1976

[51] Int. Cl.[2] ..... B41J 33/10

[52] U.S. Cl. ..... 197/168; 197/151; 197/171

[58] Field of Search ..... 197/171, 153 R, 159, 197/151, 168; 101/336

[56] References Cited

U.S. PATENT DOCUMENTS

| | | | |
|---|---|---|---|
| 539,683 | 5/1895 | Johns | 197/168 |
| 764,342 | 7/1904 | Booth | 197/168 |
| 1,942,722 | 1/1934 | Mosfelt et al. | 197/168 X |
| 1,958,764 | 5/1934 | Mosfelt et al. | 197/153 R |
| 2,475,336 | 7/1949 | Petz | 197/168 |
| 2,685,357 | 8/1954 | Koreska | 197/168 |
| 2,714,850 | 8/1955 | Kistner | 101/336 X |
| 3,863,749 | 2/1975 | Perry et al. | 197/168 X |
| 3,887,056 | 6/1975 | Lehmann | 197/168 |
| 3,904,015 | 9/1975 | Boyden et al. | 197/159 X |
| 3,973,707 | 8/1976 | Pratt et al. | 197/168 X |

*Primary Examiner*—Ernest T. Wright, Jr.
*Attorney, Agent, or Firm*—J. T. Cavender; Wilbert Hawk, Jr.; George J. Muckenthaler

[57] ABSTRACT

An endless ribbon follows a path around a U-shaped guide member and is driven by a drive roller which is in contact with an inking roller. The inked ribbon has a loose or slack portion in the area immediately downstream of the drive roller but the ribbon is taut or tensioned across the open end of the guide member and upstream of the drive roller. The guide member has a ribbed tracking surface with spaced flanges for maintaining the ribbon in a precise path past a printing station. The loose or slack portion of the inked ribbon enables the ribbon to adhere to or track on the ribbed surfaces and also allows the ribbon to gravitate to a flange portion of the guide member.

3 Claims, 4 Drawing Figures

FIG. 2
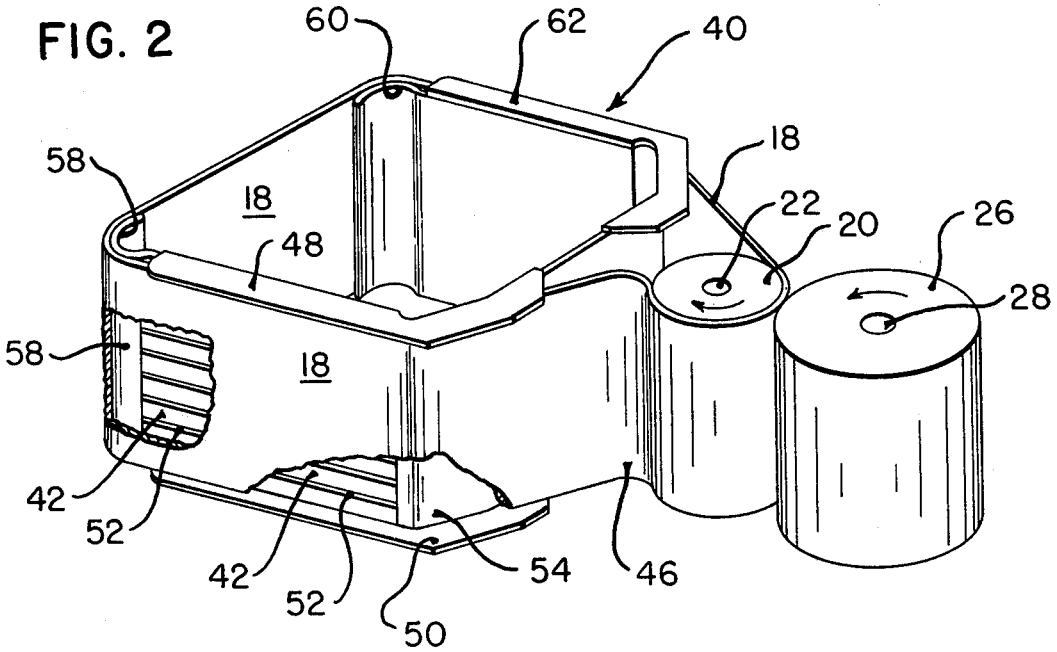
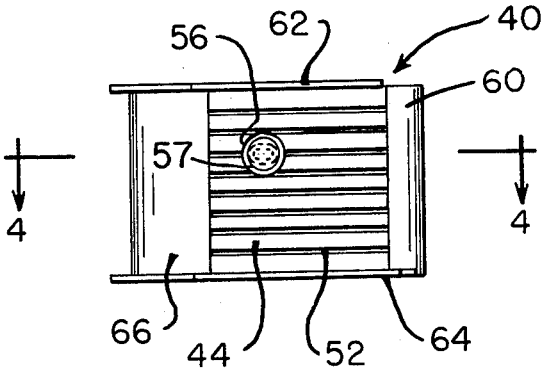
FIG. 3
FIG. 4
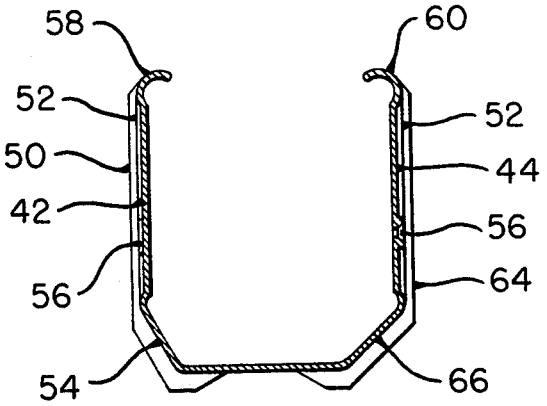

INKED RIBBON GUIDE MEMBER WITH TRACKING SURFACES THEREON

BACKGROUND OF THE INVENTION

In the field of inked ribbons for printing operations, there have been various ways and means for inking the ribbon and for controlling the path or attitude of the ribbon in the area immediately prior to and past the print station. It is, of course, desired to have the ribbon track along a path whereby the ribbon is controlled in a precise manner, both laterally and vertically, in the area adjacent each side of and past the print station. In the past the tracking of an endless ribbon has been a problem unless extreme care was exercised in providing guide means for the ribbon in the nature of pins, posts, etc. and adjusting of same so as to provide and maintain a properly inked ribbon in a precise path to minimize "down time" of printing.

In some printing applications, the endless ribbon is contained in a cassette and includes a plurality of coils of the ribbon in an area adjacent an inking core member, the ribbon driven in a taut or tensioned manner from the plurality of coils thereof, past the print station, and back to the coils. In other printing applications, the endless ribbon is contained in a cassette of the stuffing box type, wherein the ribbon is pulled through an opening, guided past the print station, and then made to re-enter the cassette, the ribbon being stuffed or folded in an "uncontrolled" manner inside the cassette.

Representative prior art in the endless ribbon field is shown in British Patent No. 12,870, dated June 4, 1913, and issued to R. Bürk, wherein an inking ribbon is driven by rollers from a printing station and into a container, the ribbon being loose therein and then taut at the exit of the container.

British Patent No. 29,235, dated Dec. 18, 1913, and issued to Stockall et al., discloses an ink ribbon mechanism wherein an endless ribbon is contained loose within a magazine and is driven by a feed roller and a friction roller, the ribbon being loose or slack in the area beyond the drive roller and tensioned or taut in the operating area around the guide rollers and the type wheels.

IBM Technical Disclosure Bulletin, Volume 7, No. 12, May 1965, Page 1212, shows an endless ribbon feed wound in turns around a pair of bobbins and directed by various pin or bar guides and lift guides past the printing station where the ribbon is kept in constant tension.

IBM Technical Disclosure Bulletin, Volume 13, No. 11, April 1971, page 3324, shows a reversible endless tape cassette having flanged wheels with a spring mounted to bear against the axles to maintain the edge of the flanges against portions of the case. A capstan pushes one of the wheels inward and drives the tape between the flanges of the wheel and a portion of the case.

IBM Technical Disclosure Bulletin, Volume 15, No. 2, July 1972, Page 543, shows an endless fold ribbon cartridge with drive rollers for driving the ribbon from an operating area into "sine wave shaped" folds downstream of the drive rollers.

U.S. Pat. No. 3,400,800 issued to N. McMillan et al. on Sept. 10, 1968, shows printing ribbon support apparatus including ribbon guide means wherein end pieces with ears each have a flange plate associated with ribbon mandrels to carry the ribbon past a printing station. A plate, a shim and a guide bar provide trough space for the ribbon, and an inner surface functions to guide the edge of the ribbon and to restrain it from moving laterally.

And, U.S. Pat. No. 3,814,231 issued to S. D. Cappotto on June 4, 1974 shows a stuffed ribbon cartridge having an endless ribbon loosely contained in the cartridge and movable by a feed roller and an idler roller along an arm for guiding the ribbon past a print point. A shroud is provided near the exit area of the ribbon cartridge to retain all but a single strand of ribbon from being fed from the cartridge.

SUMMARY OF THE INVENTION

The present invention relates to endless ribbons and more particularly to tracking apparatus for guiding an inked ribbon from a drive member, past a printing or endorsing station and returning to the drive member. The endless ribbon is of a length in relation to the path taken by the ribbon in that a slack portion thereof is provided in the area immediately beyond the drive member or roller, i.e., the length of the ribbon is greater than a direct path taken from the drive member, past the printing station, and back to the drive member. Since the inking roller is adjacent the drive roller, the ribbon is in an inked condition and therefore wet in the area immediately downstream of the drive roller. Such condition of the ribbon together with the slackness or looseness thereof in the area beyond the drive roller causes the ribbon to tend to take a path as far as possible around the drive roller with the consequence that the ribbon assumes a path against the guide member earlier in the ribbon travel than if the ribbon is maintained in a taut or tensioned condition in this area of the ribbon path.

Since the ribbon is, in effect, pulled by the drive roller from the upstream side thereof, the ribbon is in a taut condition along one side of the U-shaped guide member and is also taut in the area past the printing station, i.e., the open end of the U-shaped member. Also, since the ribbon is inked and therefore wet in the area immediately beyond the drive and inking rollers, and since the ribbon is slack or loose in this area, a greater portion of the ribbon is available for tracking along the U-shaped guide member, and the drive roller effectively causes the ribbon to be taut in the area past the printing station and along the guide surface therebeyond. The U-shaped guide member includes a plurality of spaced ribs or elongated projections along the sides thereof and directed in a path with the travel of the ribbon, the ribs providing an adhering surface of limited contact area for the web ribbon while allowing the ribbon to move vertically or gravitate to a lower flange of the guide member in a self-tracking action.

In line with the above discussion, the principal object of the present invention is to provide means for controlling the tracking of an endless ribbon.

Another object of the present invention is to provide an endless ribbon of greater length than the normal path required thereby to enable additional surface area of the ribbon to be engaged by guide means downstream of the ribbon drive means.

An additional object of the present invention is to provide ribbon guide means adjacent a printing or endorsing station wherein the inked ribbon has a slack portion therein and effectively adheres to a ribbed surface of the guide means on one side of the printing station.

A further object of the present invention is to provide an endless ribbon, drive and inking means therefor, and guide means adjacent the printing station, the ribbon having a slack portion in the area after inking thereof and assuming a precise path along the guide means for controlling the tracking of the ribbon past the printing station.

Additional advantages and features of the present invention will become apparent and fully understood from a reading of the following description taken together with the annexed drawing, in which:

FIG. 2 is a perspective view of the inking ribbon and the guide means therefor and showing the relative path of the ribbon tracking;

FIG. 3 is a detailed view of the guide member showing the ribbon tracking surface thereon; and FIG. 4 is a view taken on the plane 4—4 of FIG. 3.

Figure 1:
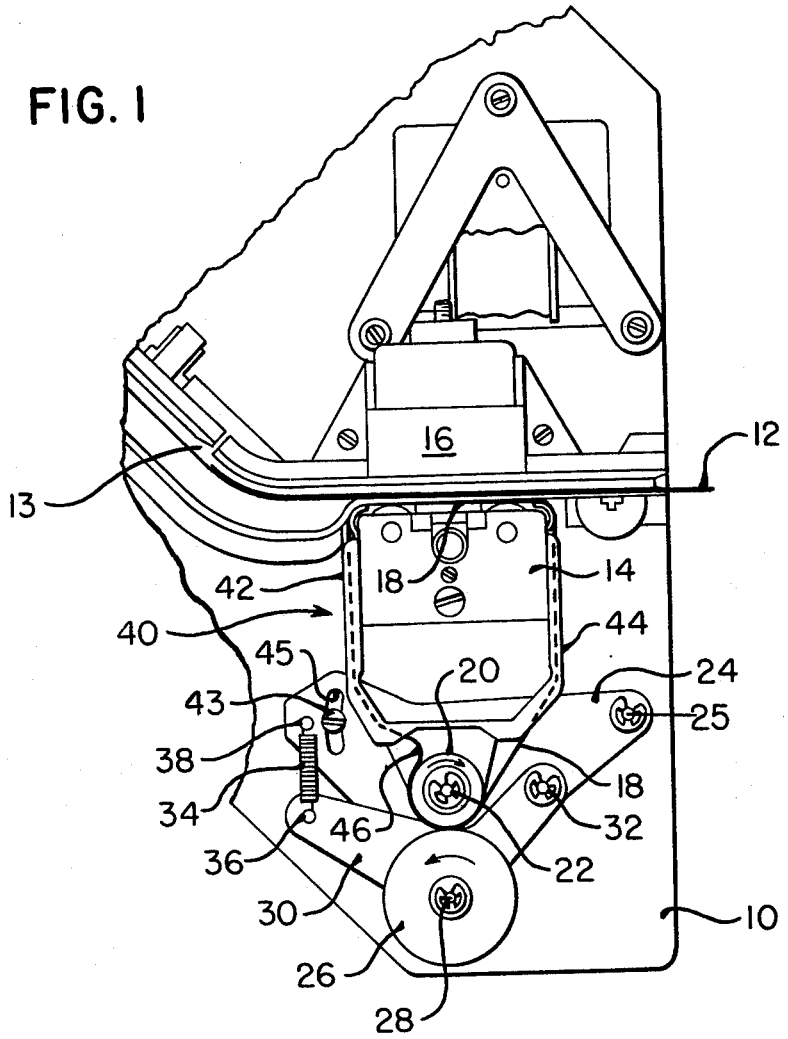
FIG. 1 is a top plan view of printing equipment incorporating the subject matter of the present invention.

Referring to FIG. 1, the subject matter of the present invention is utilized in a document endorser supported from frame means 10 wherein the documents 12 are caused to be carried or transported along a path 13 past an endorsing head 14. The head 14 is of the impact type and the document 12 is juxtaposed a back-up or like platen member 16 which provides a surface against which the document 12 is positioned or maintained while impacting thereon by the endorsing head 14, the area or zone between said head 14 and back-up member 16 defining an endorsing or like operating station of the document endorser.

In order to provide a clear and distinct mark of endorsement on the documents 12 as they are driven past the endorsing head 14, an inking ribbon 18 is caused to be moved in driven manner past the endorsing station, the ribbon 18 being, in effect, continuously inked so as to provide a wet ribbon 18 at the endorsing station. Drive means for the ribbon 18 is provided by a drive roller 20 secured to a shaft 22 journaled in a support member 24 and driven by motor means (not shown). The support member 24 is pivotable on a pin 25 carried by the frame means 10. An inking roller 26 is journaled on a shaft 28 supported from a crank arm 30 pivoted at pin 32 on the support member 24, the crank arm 30 being urged by a spring 34 connected between a pin 36 on such crank arm 30 and a pin 38 on the support member 24. Selection of the spring 34 and the tension therein is dictated by the amount of contact pressure required and exerted by the inking roller 26 against the drive roller 20, with the ribbon 18 traveling therebetween, to provide both a positive drive for the ribbon 18 and a proper amount of ink to be added thereto by the inking roller 26.

The ink ribbon 18 is of the endless type and adapted to be continuously inked or re-inked by the ink roller 26, the length of the endless loop of ribbon 18 being more than sufficient to surround a guide member, generally designated as 40, for directing the ribbon 18 in a path from the drive roller 20 along a first guide surface 42 of the member 40 downstream of the roller 20, across an open end of the guide member 40, and along a second guide surface 44 of such member 40 upstream of the drive roller 20. Above and beyond the length of the loop of ribbon 18 to reach around the drive roller 20 and the guide member 40, the ribbon 18 includes the extra length to provide a slack or loose portion 46 in one area of the ribbon 18 when installed and operating in the desired manner. In this respect, as illustrated in FIG. 1, the support member 24 is swingably adjustable on the pivot pin 25 by means of a screw or bolt 43 in a curved slot 45 to adjust the position of the drive roller 20 in relation to the guide member 40.

FIG. 2 shows a perspective view of the drive roller 20, the inking roller 26, the guide member 40, and the ink ribbon 18 with the slack or loose portion 46 thereof occupying the space downstream of the drive roller 20 and upstream of the first guide surface 42 of the guide member 40. The guide member 40 includes an upper flange 48 and a lower flange 50 adjacent the guide surface 42 for directing and maintaining the ribbon 18 in a generally straight path in the immediate area prior to the endorsing station. Further to this feature of the invention, the ribbon 18, upon the inking or re-inking thereof by the inking roller 26 in traveling therepast, includes the portion 46 which is newly re-inked and in a wet condition and tends to track with or adhere to the surface of the drive roller 20 when such roller 20 is driven in the clockwise direction, as shown in FIGS. 1 and 2. This condition of the ribbon 18 and the attitude of the slack or loose portion 46 thereof in the area immediately beyond or downstream of the drive roller 20 permits guiding of the ribbon 18 in a precise path along the first guide surface 42, across the guide member open end, defined by spaced terminal portions 58, and 60 of the guide member 40, and along the second guide surface 44 (FIG. 3). The tendency of the slack or loose portion 46 of the ribbon 18 to track around the peripheral surface of the drive roller 20 moves that portion of the ribbon 18 into contact with a surface portion 54 of the guide member 40 ahead of the first guide surface 42, i.e., at a point nearer the drive roller 20. The wet condition of the ribbon 18 at this point causes the ribbon 18 to track or adhere to the surface portion 54 of the member 40 so as to cause the ribbon 18 to be directed in a precise or desired path along the first guide surface 42 in the area immediately upstream of the guide member open end and allowing the ribbon to self-track along such guide surface 42.

As shown in FIG. 2, the portion of the first guide surface 42 along which the ribbon 18 tracks prior to passing the endorsing station area of the instant document endorser, i.e. across the guide member open end, includes a plurality of ribs or elongated projections 52 which provide the actual contact surface for the ribbon 18 as it is guided toward the endorsing station area, the actual contact surface of the ribbon 18 being limited by the edge surface of the ribs 52. In this respect the limited contact surface of the ribs 52 enables the ribbon 18 to be self-tracking along the guide surface 42. As mentioned previously, the guide member 40 also includes the surface portion 54 which, in the preferred form of the invention, is a smooth surface of limited area at the corner of the guide member 40 (see also FIG. 4) where the wet ribbon 18 initially contacts the guide member 40 after leaving the drive roller 20 (FIGS. 1 and 2). It is of course axiomatic that such surface portion 54 might likewise carry ribs or other abutments thereon so as to present a non-smooth surface accommodating ribbon adherence thereto. A boss 56 is provided in each side of the guide member 40 for accommodating an appropriate flat-headed screw 57 or the like to secure the guide member 40 to suitable support means in proper position in relation to the endorsing head 14 and the drive roller 20.

When the ribbon 18 is drawn around the edge or corner terminal portion 58 immediately beyond the first guide surface 42 of the guide member 40, the ribbon 18 is placed in a taut or tense condition across the guide member open end and is likewise in a taut condition when traveling along the second guide surface 44 and in actual contact with the additional ribs 52 thereof (FIGS. 3 and 4). In this area of the ribbon loop, the ribbon 18 is being pulled by the drive roller 20 and the inking roller 26 in cooperation therewith. It is thus seen that the ribbon 18 is in a slack or loose condition in the portion 36 immediately beyond the drive roller 20, and after tracking along the first guide surface 42 of the guide member 40 the ribbon 18 is maintained in a taut or tensioned condition at the guide surface 42 terminating edge or corner 58 of the guide member 40, across the guide member open end, around the beginning edge or corner terminal portion 60 of the second guide surface 44 of the guide member 40, along the second guide surface 44 and to the drive roller 20. Thus, while the ribbon 18 is slack or loose in the vicinity upstream of the endorsing station, such ribbon 18 is taut or tensioned in the vicinity downstream of the station.

The U-shaped guide member 40 also includes an upper flange 62 and a lower flange 64 on the side thereof upstream of the drive roller 20 — that is, on the second guide surface 44 which also has ribs 52 therealong for tracking of the ribbon 18 (FIG. 3). Once again a smooth surfaced portion 66 (FIG. 4) occupies the area immediately upstream of the drive roller 20, such portion 66 being of slightly larger diameter than the portion 54 immediately downstream of the roller 20.

The guide member 40 is preferably made of a plastic material such as medium impact polystyrene or the like and provides means for guiding the ribbon 18 in improved tracking manner prior to, past, and beyond the endorsing station. The ribs 52 permit the wet ribbon 18, beyond the slack or loose portion 46 thereof, to track on the surface of the ribs 52 along both guide surfaces 42 and 44 in limited surface contact manner and tending to sufficiently adhere to the ribs 52 for guiding and tracking of the ribbon 18, while allowing the ribbon 18 to gravitate towards the lower flanges 50 and 64.

It is thus seen that herein shown and described is tracking means for an inked ribbon 18 wherein the ribbon 18 includes a loose or slack portion 46 adjacent the ribbon drive roller 20 for enabling the ribbon 18 to be directed in a precise path toward and across an endorsing station and wherein the ribbon 18 is pulled in a taut manner by the combined action of the drive roller 20 and the inking roller 26. The apparatus enables the accomplishment of the objects and advantages mentioned above, and while only one embodiment of the invention has been disclosed herein, variations thereof beyond those herein mentioned may occur to those skilled in the art. It is contemplated that all such variations, not departing from the spirit and scope of the invention hereof, are to be construed in accordance with the following claims.

What is claimed is:

1. Tracking apparatus for a moving endless ribbon comprising drive means, driven means adjacent said drive means and cooperating therewith, said driven means including means for inking said ribbon and providing wetting thereof, and guide means for directing said inked ribbon in a path distal from said drive means and said driven means, said guide means having a smooth surface portion adjacent said drive means and a ribbed guide surface downstream of said smooth surface portion, said endless ribbon having a slack portion adjacent said drive means and initially engageable with said smooth surface portion of said guide means and tending to adhere thereto by reason of the wet condition of said ribbon and therefrom engageable with said ribbed guide surface of said guide means in limited contact elongated manner in the direction of movement of said ribbon to enable said endless ribbon to track along said guide means.

2. In record media marking apparatus having an operating station, means providing tracking of an endless ribbon adjacent said station including means for driving said ribbon, ribbon inking means associated with said driving means to provide wetting of said ribbon for use at said operating station, and means for guiding said inked ribbon during travel thereof in a path beyond said driving means and said inking means for enabling said ribbon to be self-tracking prior to traveling past said operating station, said guiding means having a smooth surface portion downstream of said driving means and a first elongated guide surface positioned along said path downstream of said smooth surface portion, said first elongated guide surface having a plurality of elongated projections thereon running in the direction of travel for limited contact thereof by said ribbon, said ribbon including a slack portion therein beyond the inking means and said slack portion tending to adhere to said driving means in the direction of rotation thereof and tending to adhere to said smooth surface portion prior to engagement with said first elongated guide surface, and said guiding means including a second guide surface with elongated projections thereon beyond said operating station for tracking said ribbon back to said driving means.

3. In endorsing apparatus having platen means, impact means operably associated with said platen means, and means causing documents to be advanced past an operating station defined by said platen means and said impact means, an endless ribbon, a drive roller and a driven roller spaced from and operating to move said ribbon past said operating station, said driven roller including means for inking said ribbon, and means for guiding said ribbon in a path from the drive and driven rollers to said operating station and from the operating station to said drive and driven rollers, said guiding means including a smooth surface portion downstream of said drive roller and a first guide portion having a plurality of parallel projecting surfaces downstream of said smooth surface portion and directed along said ribbon path, the length of the endless ribbon defined by the loop thereof being greater than the path thereof defined by the guiding means so as to provide a slack portion in said ribbon, the slack portion of said ribbon tending to adhere to said drive roller in the direction of rotation thereof and to said smooth surface portion and tracking along the projecting surfaces of said guiding means in a limited contact manner upstream of said operating station for maintaining a desired attitude of said ribbon therepast, and a second guide portion upstream of said drive roller, said second guide portion having a plurality of parallel projecting surfaces for guiding said ribbon in taut condition to said drive roller.

* * * * *